US005402975A

United States Patent [19]

Sullivan et al.

[11] Patent Number: 5,402,975

[45] Date of Patent: Apr. 4, 1995

[54] STANDARD AND BRACKET SUPPORT SYSTEM WITH COUPLING DEVICE

[75] Inventors: Lloyd Sullivan, Seattle; Kenneth S. Roberts, Gig Harbor, both of Wash.

[73] Assignee: Phoenix Display Corporation, Kent, Wash.

[21] Appl. No.: 63,621

[22] Filed: May 18, 1993

Related U.S. Application Data

[63] Continuation-in-part of Ser. No. 928,957, Aug. 12, 1992.

[51] Int. Cl.[6] ..... A47G 29/02

[52] U.S. Cl. ..... 248/246; 248/243; 248/297.3; 108/108

[58] Field of Search ..... 248/243–246, 248/235, 297.3, 250; 108/108

[56] References Cited

U.S. PATENT DOCUMENTS

| | | | |
|---|---|---|---|
| 723,677 | 3/1903 | Kade . | |
| 756,648 | 4/1904 | Kade | 248/250 |
| 1,219,158 | 3/1917 | Rose . | |
| 1,276,677 | 8/1918 | Mittleburg . | |
| 2,005,593 | 6/1935 | Onions et al. . | |
| 2,252,997 | 8/1941 | Vanderveld . | |
| 2,639,817 | 5/1953 | Ehret . | |
| 2,703,692 | 3/1955 | Felix . | |
| 2,703,693 | 3/1955 | Cropanese . | |
| 3,080,980 | 3/1963 | Gibbons . | |
| 3,111,916 | 11/1963 | Bjerke . | |
| 3,158,349 | 11/1964 | Bergstrom . | |
| 3,225,720 | 12/1965 | Maslow . | |
| 3,242,886 | 3/1966 | Chesley . | |
| 3,355,134 | 11/1967 | Chesley . | |
| 3,429,540 | 2/1969 | Worrallo . | |
| 3,565,381 | 2/1971 | Oliver | 248/250 X |
| 3,710,734 | 1/1973 | Bofferding . | |
| 3,810,430 | 5/1974 | Siegal . | |
| 3,865,337 | 2/1975 | Towfigh . | |
| 4,033,540 | 7/1977 | Hamblin . | |
| 4,077,522 | 3/1978 | Trubiano . | |
| 4,102,275 | 7/1978 | Spound et al. . | |
| 4,103,855 | 8/1978 | Grosse . | |
| 4,156,515 | 5/1979 | Mochly . | |
| 4,170,335 | 10/1979 | King . | |
| 4,174,486 | 11/1979 | Winkler . | |
| 4,223,863 | 9/1980 | Birman . | |
| 4,274,614 | 6/1981 | Worrallo . | |
| 4,335,861 | 6/1982 | Klaric . | |
| 4,421,289 | 12/1983 | Sturm . | |
| 4,534,529 | 8/1985 | Dorner . | |
| 4,603,782 | 8/1986 | Fenwick . | |
| 4,609,172 | 9/1986 | Dorner . | |
| 4,671,481 | 6/1987 | Beard . | |
| 5,063,715 | 11/1991 | Goodman . | |

FOREIGN PATENT DOCUMENTS

| | | | |
|---|---|---|---|
| 972717 | 8/1975 | Canada | 248/246 |
| 2102834 | 7/1971 | Germany | 248/246 |
| 1149568 | 4/1969 | United Kingdom | 248/250 |

*Primary Examiner*—Alvin C. Chin-Shue
*Attorney, Agent, or Firm*—Bogle & Gates

[57] ABSTRACT

A standard and bracket support system is provided. The standard portion includes an elongated standard having opposed front and back walls. One or more brackets are coupled to the standard. An engagement member for engaging a shelf or other supportive item is coupled to the bracket. The shelf-engagement member includes a slot which receives a portion of a bracket. The shelf-engagement member is coupled to a shelf or other supported item. In one embodiment, engagement is by screwing, nailing or adhering a flat portion of the shelf-engagement member to the portion of the shelf, preferably a rear edge or bottom surface of a shelf. In another embodiment, the shelf-engagement member is an elongated member with a channel for receiving an edge of a shelf or other supported item.

4 Claims, 16 Drawing Sheets

468
470
466
422
472
460
458
454
452
450
444
440
442
16

452a
476
452b

STANDARD AND BRACKET SUPPORT SYSTEM WITH COUPLING DEVICE

This application is a continuation-in-part of U.S. application Ser. No. 07/928,957, filed on Aug. 12, 1992 for "Standard and Bracket Support System," incorporated herein by reference.

The present invention relates to a standard and bracket support system with coupling devices for supporting items such as shelves, displays, clothes hanger rods and the like, and particularly to a standard and bracket system that is economical to produce and yields continuous, rather than discrete, height adjustability.

BACKGROUND OF THE INVENTION

Certain previous support systems for supporting shelving, display items, clothes hanger rods and the like have suffered from a number of deficiencies. Many of these systems have provided inadequate or no direct coupling to the item being supported (such as shelving, display items, clothes hanger rods and the like), relying only on, e.g., gravity and/or frictional forces. Many previous devices have permitted an unacceptable degree of lateral movement or "sway" of the brackets and/or the supported shelving. Previous devices have been expensive or difficult to produce, install or maintain.

Many previous systems for supporting shelving, display items, clothes hanger rods and the like have provided for shelf support at discrete heights so that the user cannot select the support height in a continuous fashion. Early efforts to provide for a continuous support system have been unsatisfactory for a number of reasons, including a comparatively high expense of such systems. U.S. Pat. No. 2,703,692, issued Mar. 8, 1955 to Felix discloses a system of uprights and supporting arms intended to permit setting the supporting arm at a required height. The supporting arms of Felix had a side projection which is believed to make it impractical to produce by a stamping operation. More complicated production techniques contribute to the expense of the device. Felix provided for a point on the heel portion of the support for penetrating into the back wall of the upright. Such deformation of the back wall can provide an unsightly device, particularly when a high-finish system is required. The deformation also detracts from infinite adjustability since, whenever the point is positioned sufficiently near a previously formed depression, the pre-existing depression will tend to guide the point of the support away from the desired location, preventing the user from readjusting a shelf to a location close to the original location. Felix provided for a cam action, but considered it necessary to combine this with a wedge device and a point device, and disclosed using the Ycombination of all three to achieve the necessary support.

U.S. Pat. No. 3,865,337 issued Feb. 11, 1975 to Towfigh, et al. discloses a standard and bracket system with a pin secured to the bracket. In the system of Towfigh, a portion of the bracket body is used in maintaining the bracket at the desired height. In particular, a portion of the bracket (the portion between the pin and the back surface) is compressed within the standard. The back surface of the bracket is pressed against the back wall of the standard so that the thickness of the bracket body determines the portion of the back wall over which the clamping pressure is distributed.

Commercial systems employing a pin and bracket system have been found to have relatively high costs, at least partly since a thick bracket body (e.g., ¼ in. or more) is needed to distribute clamping force over the standard back wall sufficiently to avoid punch-through or rupture of the back wall. This configuration also requires a relatively wide slot to accommodate the wide bracket body. High forces are concentrated on the pin-bracket junction both because of the high clamping forces and the fact that the pin-body junction is a primary component for resisting lateral wobbling of the bracket. The high forces are believed to contribute to enlargement of the pin hole. Attempts to enhance support by employing softer materials such as aluminum (e.g., to provide bearing support as a supplement to friction support) may reduce the bracket lifetime because of the high forces between the pin and the soft metal body. Use of metals such as aluminum for the standard portion of the device result in plastic deformation of the standard leaving gouges or detents in the back wall (which are highly visible because of the wide slot required) and in the front wall (which partially convert the device from a friction clamp to a bearing device). Creation of plastic deformation is enhanced by providing a pin location (with respect to the bracket back surface) which exceeds the standard depth by about 0.02 inches (about 0.5 mm) or more. Formation of gouges or detents limits the continuous nature of the height adjustability since the bracket tends to move to a previously formed detent if an attempt is made to position the bracket near a previous detent.

Accordingly, it would be useful to provide a support system which includes efficient systems and methods for coupling a support system bracket or arm to the item being supported (e.g., shelving, display items, clothes hanger rods and the like). It would be useful to provide a system which reduces or eliminates lateral sway of brackets and/or supported items while providing ease and low cost of materials, production, installation and maintenance. It would further be useful to provide a support system which has continuous height adjustment, is easily manufactured such as by roll forming and/or stamping, and avoids or minimizes gouging or other plastic deformation of components. In one embodiment, previously-available, off-the-shelf steel tubing can be used for the standards.

SUMMARY OF THE INVENTION

The present invention includes a support apparatus and method in which a shelf-engagement member having a first slot is provided for coupling to the supported item, such as a shelf. The shelf-engagement member has a device for engagement to both the bracket and to the shelf or other supported item. In one embodiment, the device for coupling to the bracket has a slot to receive a portion of the bracket. In one embodiment, the shelf-engagement member is a tab-like, preferably planar or L-shaped member having a slot for receiving a portion of the bracket and a region for coupling to the supported device, such as a region for nailing, screwing or adhering the device to a shelf. In one embodiment, the shelf-engagement member is an elongated runner having an elongated slot for receiving a portion of the bracket and one or more channels for receiving edges of a shelf or other item being supported. Preferably, the bracket is at least partially engaged with an elongated standard. In one embodiment, the standard has first and second non-coplanar front walls.

One embodiment of the present invention includes a standard and bracket system in which the heel portion of the bracket is coupled to a transverse plate. The transverse plate has a length slightly greater than the front-to-back interior spacing of the standard, when the standard is in an unstressed condition. The transverse plate fits easily into the interior of the standard when the bracket is tilted in a first non-locked position. Moving the bracket towards a locked position causes the plate to bear against opposed interior surfaces of the standard. As the plate approaches and passes through a configuration in which it is orthogonal to the axis of the standard, the standard slightly deforms to accommodate the plate. After passing through the orthogonal position, the plate is stopped at a slight angle to the axis of the standard, e.g., by contact of the bracket heel bottom with an interior surface of the standard. In this position, the standard is slightly elastically deformed and provides sufficient compression on the plate, accompanied by contact with the bottom portion of the heel, to achieve the desired support.

The rear edge of the plate is wider than the thickness of the bracket so that the clamping force is distributed over a width of the standard which is greater than the width of the bracket, thus minimizing or preventing plastic deformation or punch-through. The over-center locked position provides a predetermined or reproducible amount of friction force and provides the user with a tactile feedback, assuring the user of proper positioning of the bracket.

Aside from slight compression at the heel bottom of the bracket (acting as a stop), substantially all compression imparted by the elastically deformed standard is borne by the transverse plate. Because the plate bears against a relatively wide region of the opposed standard faces, the transverse plate can act to stabilize the bracket body against lateral wobble.

Since substantial compression of the bracket body is not needed for clamping the bracket or for lateral stabilization, and because the width of the bracket does not determine the resistance to deformation or punch-through, the bracket body can be relatively thin and can be produced by a standard stamping operation, thus providing for an economically feasible device.

DESCRIPTION OF THE PREFERRED EMBODIMENTS

Figure 1:
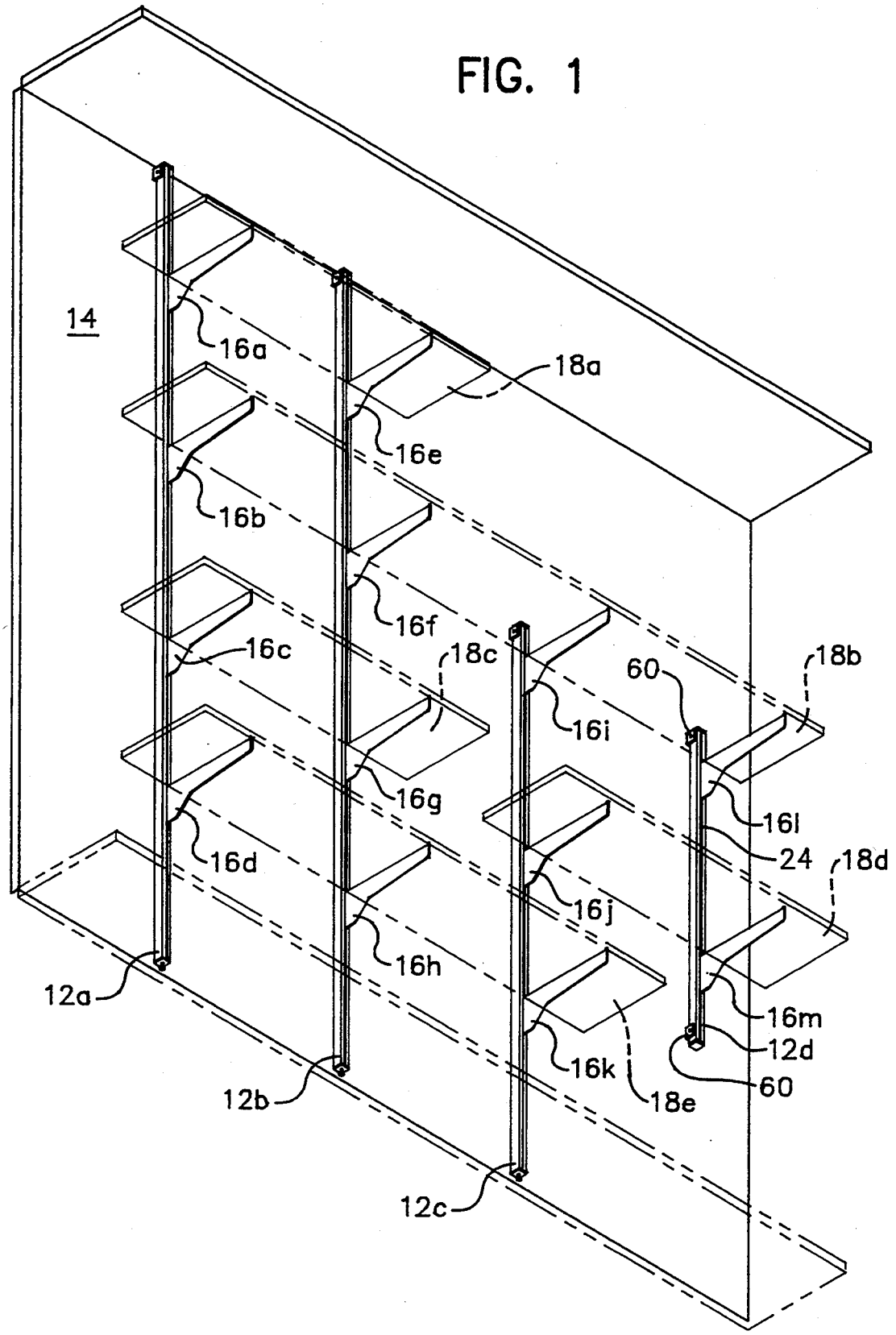
FIG. 1 is a perspective view of an installed bracket and standard system.

As depicted in FIG. 1, one or more standards 12*a*, 12*b*, 12*c*, 12*d* are attached to a wall 14 in a manner described more fully below. Each of the standards 12 can be engaged with one or more brackets 16*a*–16*m*. In the embodiment depicted in FIG. 1, the brackets 16 in the depicted locked configuration have horizontal upper surfaces which can be used, e.g., for supporting items such as shelves 18*a*–18*e*. The brackets 16 can have other configurations for supporting other types of structures, some examples of which are described below.

Figure 17:
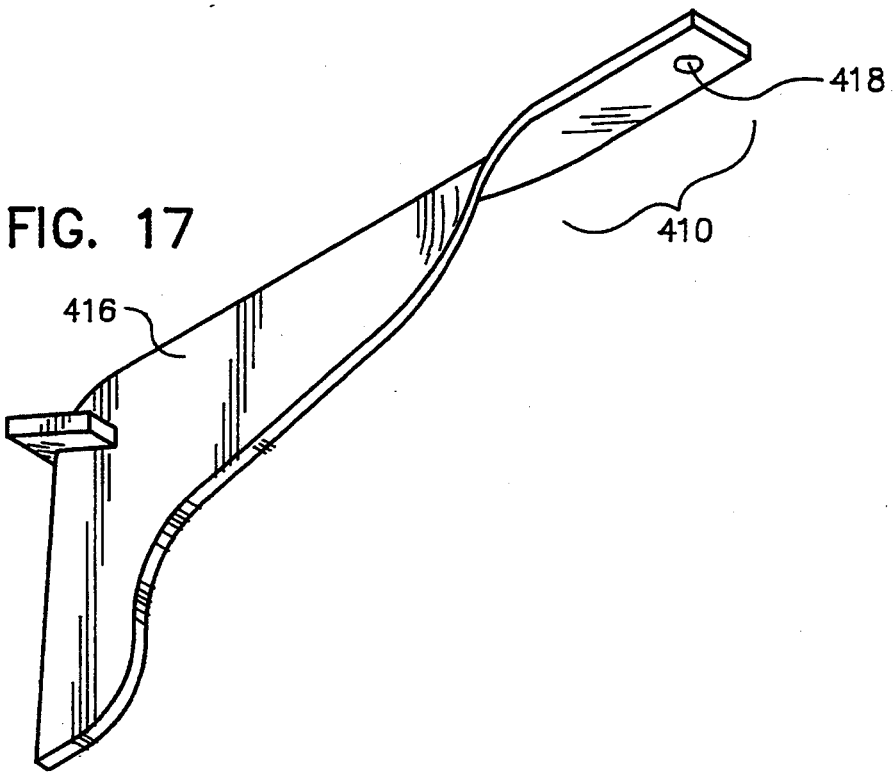
FIG. 17 is a perspective view of a standard with the tip portion twisted to accommodate a vertical screw hole.

FIG. 17 depicts a shelf-engagement member 410. The shelf-engagement member 410 is a generally planar tab device having a slot 412 for receiving a portion of the bracket 16. The slot 412 may have a flared opening 414 to facilitate installation. The shelf-engagement members 410, 420 can be made of a number of materials including a plastic, such as poly-vinyl chloride, metal, wood, fiberglass, resin, fiber-reinforced materials and the like. Preferably, the width of the slot 412, at least at the upper portion thereof, is substantially equal to the thickness 34 of the bracket (FIG. 2D) so as to closely engage the bracket. If desired, the tabs 410, 420 and brackets 16*a*, 16*b* can be provided with engaging fingers and detents, latches, or other connection devices (not shown).

The tab 410 can be provided with coupling accommodations such as holes 416*a*, 416*b* for receiving connectors such as nails, screws, bolts, rivets and the like. Alternatively, the shelf-engagement member 410 can be left without holes and coupling to a shelf or other supported item can be achieved without separate connectors, such as by using an adhesive, welding, brazing, and the like. It would be possible to produce the shelf-engagement member as an integral part of either the bracket 16 or the device to be supported, such as a shelf, although it is currently believed that such integral formation is not as cost-effective as the preferred approach of providing a separate item 410. If desired, the bracket 16 can be provided with a notch 418 for receiving portions of the tab 410, thus providing cross-wise interengaging slot 412 and notch 418.

Figure 18:
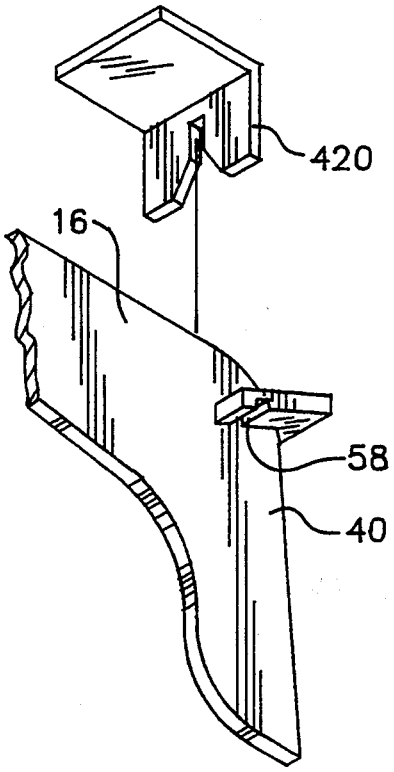
FIG. 18 is a perspective, partially exploded view showing a bracket and an L-shaped shelf-engagement member according to an embodiment of the present invention.

According to another embodiment, a shelf-engaging member 420 can be formed similar to the tab 410 depicted in FIG. 17, but in an angled or L-shaped configuration. In the embodiment depicted in FIG. 18, the bracket 16 is not provided with a notch for receiving the shelf-engaging member 420.

Figure 19:
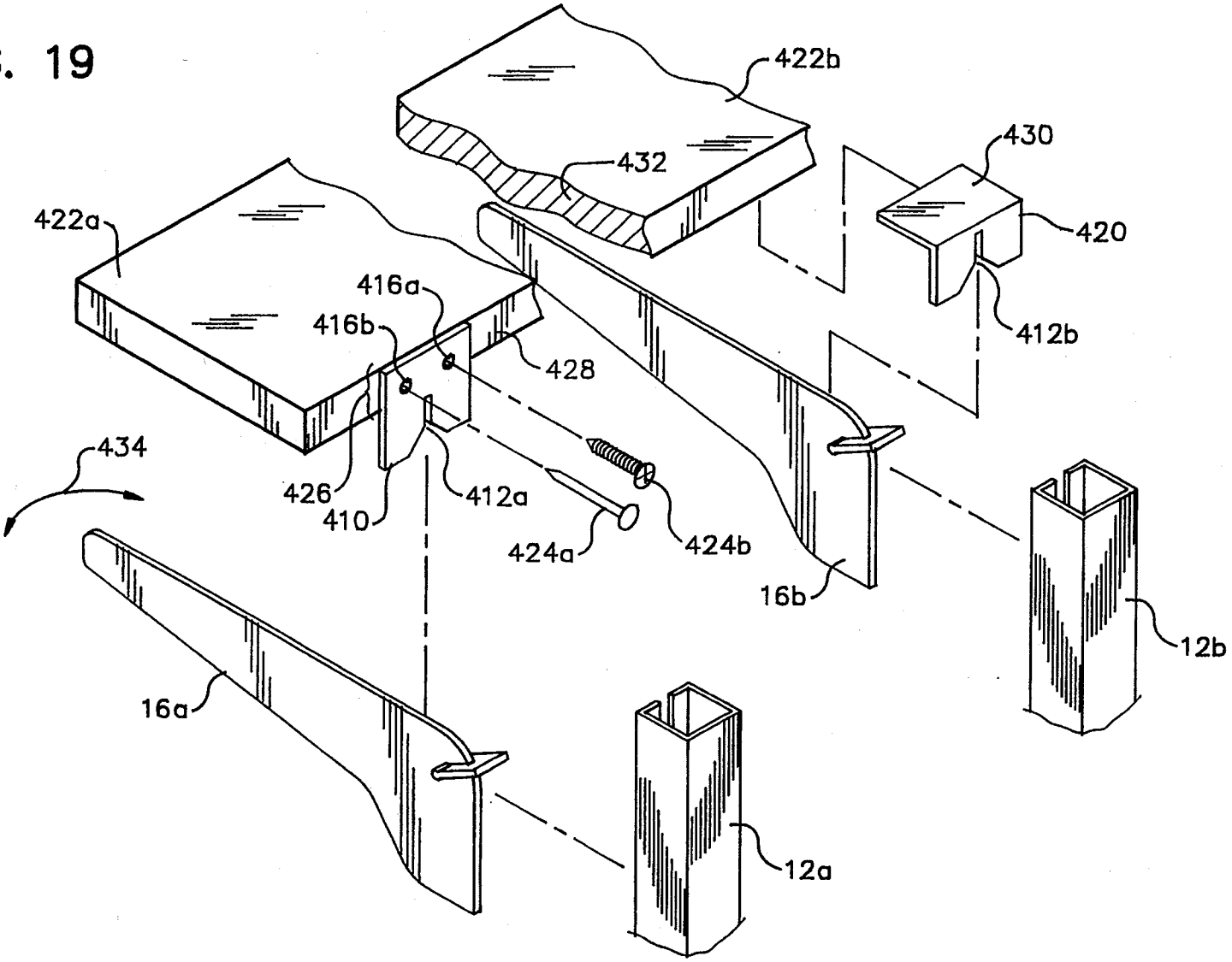
FIG. 19 is a perspective, partially exploded view showing a shelf-engagement member in connection to a shelf and to brackets according to an embodiment of the present invention.

As depicted in FIG. 19, the shelf-engaging member 410, 420 is engaged with a shelf 422*a*, 422*b* such as by connection using a nail 424*a*, screw 424*b* or other connecting device, e.g., through the holes 416*a*, 416*b* such as by attaching the connection portion 426 to the rear vertical edge 428 of a shelf 422*a* (i.e., the shelf edge nearest the standard 12*a*). The self-engagement member can be positioned flush with the edge of a sehlf support standard, for a clean aesthetically pleasing appearance. According to another embodiment, a self-engaging member 410' can include a lateral extension 419 to accomodate spaced or expanded holes 416*a*', 416*b*'. The shelf-engagement member should have a height to permit the slot 412 to extend below the shelf when the self-engagement member is attached to the shelf. In one embodiment, the shelf-engagement member 410' has a height 411 of about 0.625 inches (about 15 mm) and a width 413 of about 1.25 inches (about 30 mm). In another embodiment, the shelf-engagement member 420 can be engaged with a shelf 422*b* by attachment such as an adhesive attachment, e.g., by attaching the angled or perpendicular portion 430 to a horizontal surface of the shelf 422*b*, such as the lower surface 432. Attachment by adhesives is particularly useful when attachment using connectors such as nails and screws is difficult or infeasible such as in the case of a glass shelf. The bracket 16*a*, 16*b* are coupled to the standards 12*a*, 12*b*, e.g., as described more thoroughly below.

The shelf-engagement members 410, 420 are engaged with the brackets 16*a*, 16*b* by inserting a portion of the bracket 16*a*, 16*b* preferably a portion adjacent to the standards 12*a*, 12*b* into the slots 412*a*, 412*b*. When the shelf 422*a*, 422*b*, shelf-engagement members 410, 420, bracket 16*a*, 16*b*, and standards 12*a*, 12*b* are assembled as depicted in FIG. 19, the shelf-engagement members 410, 420 not only help to prevent a shelf 422*a*, 422*b* from slipping off the brackets 16*a*, 16*b* but also help prevent or substantially eliminate lateral movement or sway 434 of the brackets 16*a*, 16*b* and, consequently, of the shelf 422*a*, 422*b* or other supported item.

Figures 20, 22, 23:
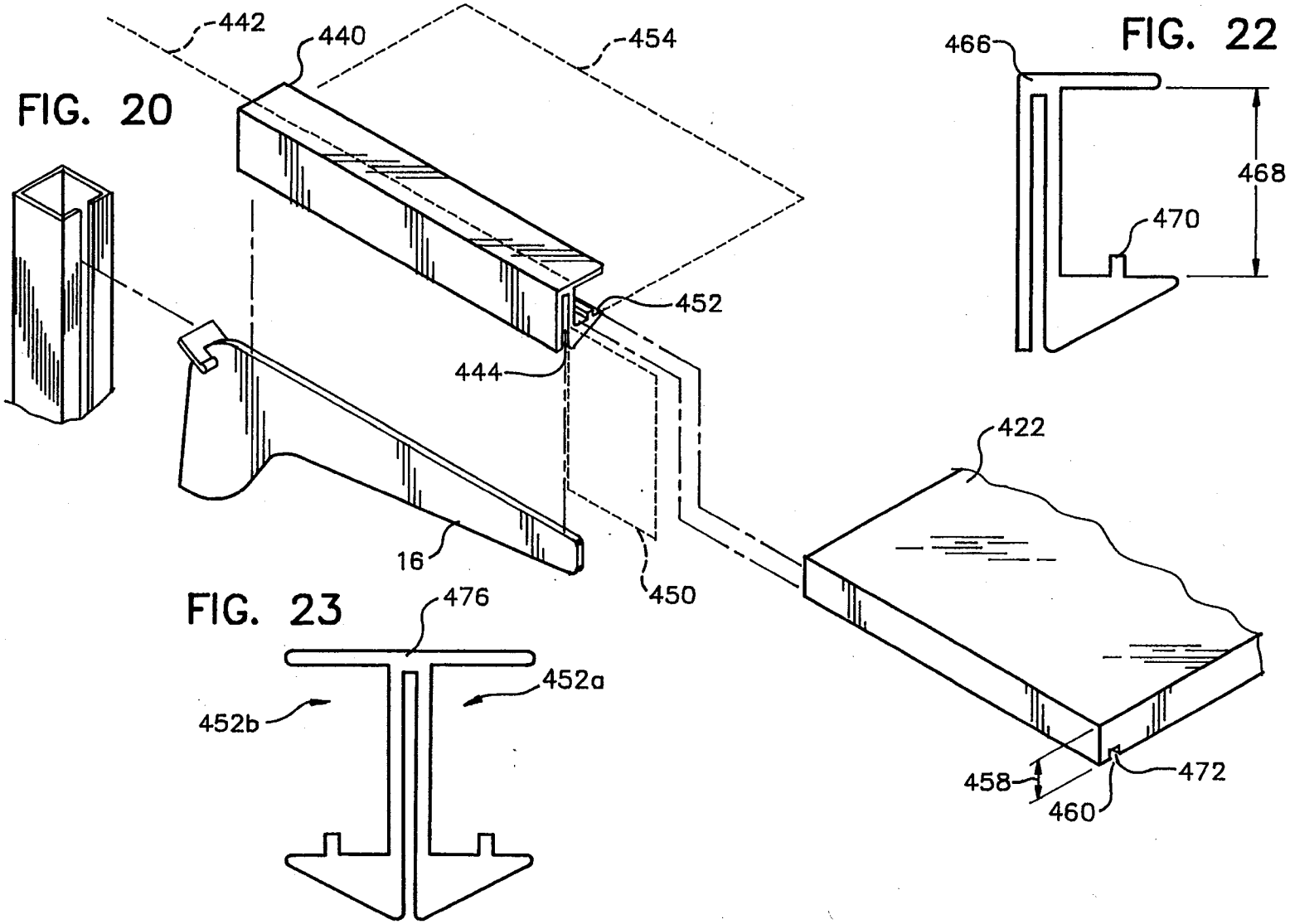
FIG. 20 is a perspective, partially exploded view depicting a shelf, bracket, standard and elongated shelf-engagement member according to an embodiment of the present invention.
FIG. 22 is an end view of a shelf-engagement member according to an embodiment of the present invention.
FIG. 23 is an end view of a shelf-engagement member according to an embodiment of the present invention.

As depicted in FIG. 20, according to another embodiment, the shelf-engaging member 440 can be a linearly extending device, preferably, extending along an axis 442 making it possible to support several shelves so as to form a continuous span. The elongated shelf-engagement member 440, in one embodiment, has a length and height sufficient to substantially cover the otherwise-exposed portion of the bracket 16. The shelf-engagement member 440 can be provided in the desired color or surface finish or texture or with desired decorations, labels, indicia, or the like to present an attractive and/or informative exterior surface and to cover up all or substantial portions of the exposed area of the bracket 16 so that the bracket 16 can be provided inexpensively, without concern as to its appearance.

Figure 21:
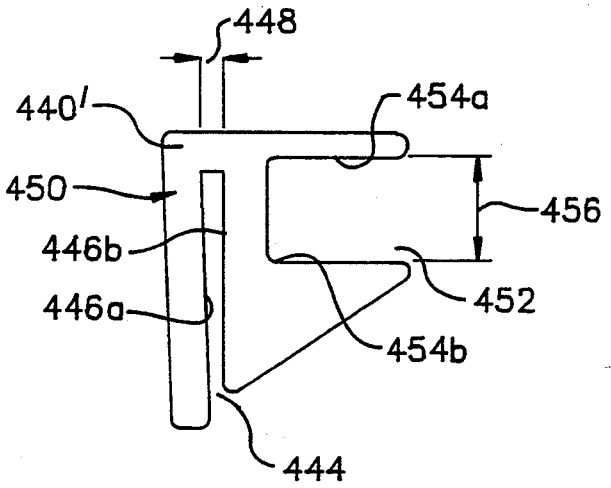
FIG. 21 is an end view of a shelf-engagement member as depicted in FIG. 20.

The shelf-engaging member 440 has a first slot 444 defined by first and second edges, 446*a*, 446*b* (FIG. 21). As seen in FIG. 20, the slot 444 defines one or more planes such as a plane 450, defined by the slot wall 446*b*. In one embodiment, the width 448 of the slot 444, defined near the upper portion thereof 450 is about 0.070 inches (about 1.8 mm), substantially equal to the width 34 of a bracket 16 and the slot 444 tapers downward somewhat, e.g., to a width of about 0.04 inches (about 1.0 mm). In one embodiment, the shelf-engaging member 440 is made of a resilient material such as a plastic, like polyvinyl chloride, or rubber and the forcing-open of the tapered slot 444 upon inserting the bracket 16 into the slot 444 causes the sidewalls 446*a*, 446*b* to resiliently grip the sides of the bracket 16. The shelf-engaging member 440 can also be made of other materials such as metal, wood, fiberglass, fiber-reinforced materials, resin and the like.

The shelf-engaging member 440 also includes a channel 452. The channel is generally C-shaped and has an upper surface 454*a* and a lower surface 454*b*. The upper and lower surfaces 454*a*, 454*b* are spaced apart to define a height 456 of the channel 452. Preferably, the height 456 is substantially equal to the height 458 of an edge 460 of a shelf 422 or other supported item. In one embodiment, the height is about 0.25 inches (about 6 m) to about 0.4 inches (about 10 mm), preferably about 0.323 inches (about 8 mm) e.g., for support of ¼ inch (6 mm) glass shelving. The orientation of the channel 452 is defined by a plane such as a plane 454 in which the lower surface 454*b* lies. In the depicted embodiment, the plane 454 is substantially perpendicular to the plane 450 of the slot 444. Each of the planes 454, 450 are parallel to the longitudinal axis 442 of the shelf-engaging member 440.

As depicted in FIG. 22, different configurations of a shelf-engaging member 466 can be provided. In the embodiment depicted in FIG. 22, the shelf-engaging member 466 has a greater channel height, such as a channel height of about 0.75 inches (about 19 mm) to about 0.85 inches (about 21 mm), preferably about 0.8 inches (about 20 mm) e.g., for support of ¾ inch (19 mm) wooden or particle board shelf. Also as depicted in FIG. 22, the channel may be provided with one or more ridges 470. In this embodiment, the shelf 422 is provided with one or more grooves 472 sized and shaped to receive the ridges 470, e.g., a 1/16 inch (1.5 mm) width ridge. The ridge 470 and groove 472 configuration provides additional engagement between the shelf 422 and the shelf-engaging member 440, 466. As depicted in FIG. 23, a shelf-engagement member 476 can be provided with two channels 452*a*, 452*b* for support of two shelves. The one-channel embodiment (FIG. 22) can be used as both a shelf-engagement member and an end cap to cover all or portions of the shelf edge.

Figures 2, 4:
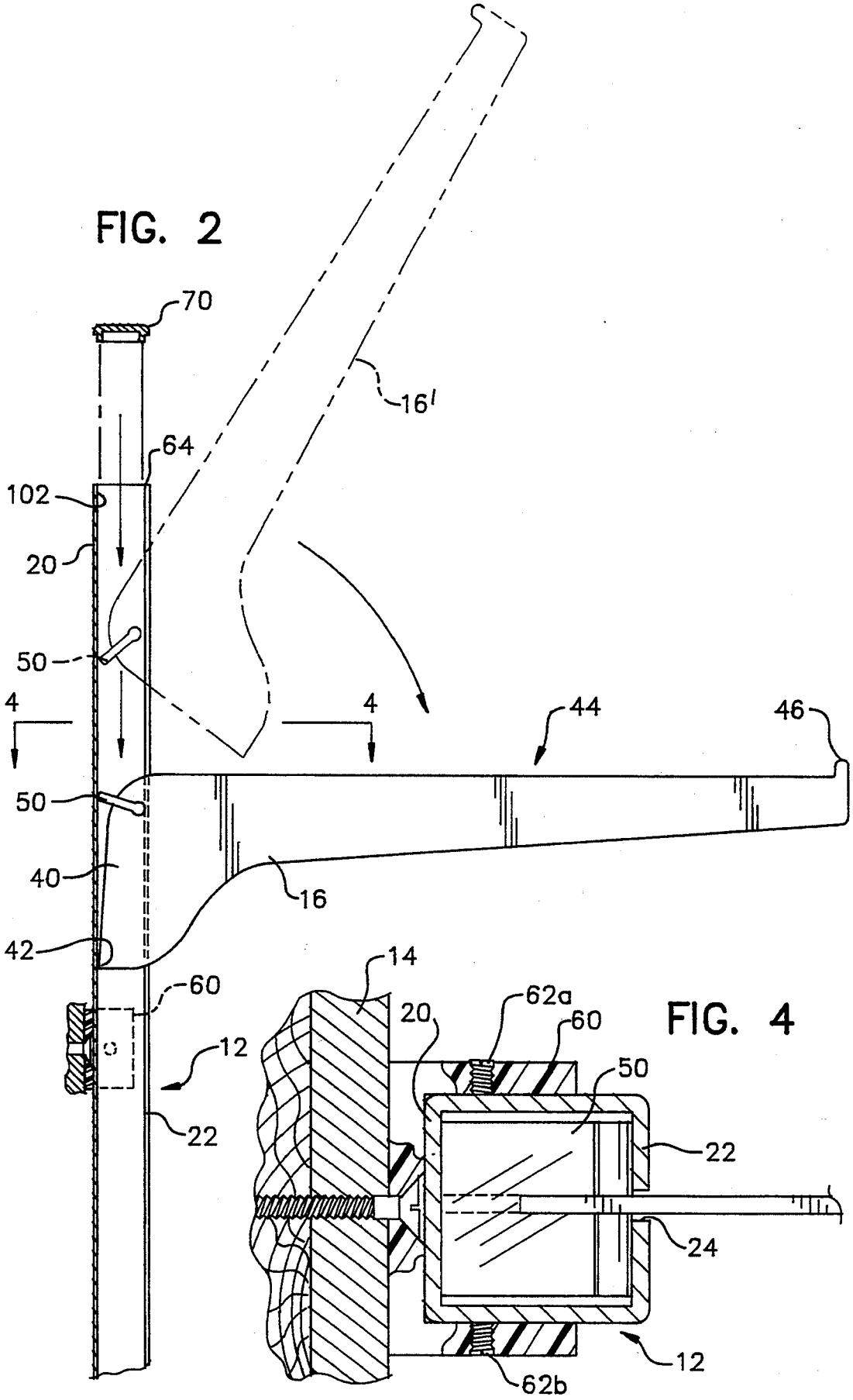
FIG. 2 is a partially exploded partial cross-sectional view of a standard and bracket system, showing a bracket in a locked position and depicting an unlocked position in phantom.
FIG. 4 is a cross-sectional view taken along line 4—4 of FIG. 2.
Figure 2A:
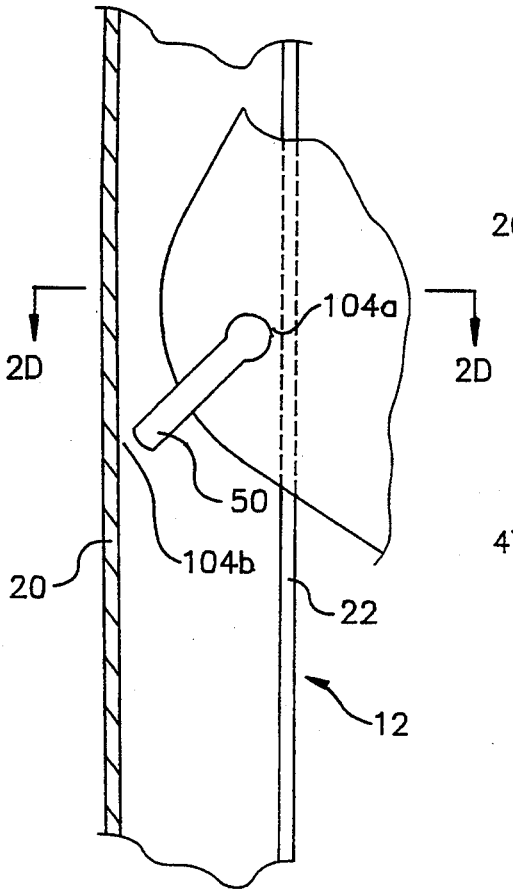
FIGS. 2A, 2B and 2C show a detail of the embodiment of FIG. 2 with three configurations of the bracket during a locking operation.

In the embodiment depicted in FIG. 2, the standard 12 includes a back wall 20 and a front wall 22. A slot 24 is formed over at least a part of the length of the front wall. As seen in FIG. 2D, according to one embodiment of the invention, the standard 12 in an unstressed condition has an exterior width 26 and exterior depth 28 of about 0.75 inches (about 2 cm). The interior width of the back wall 30 and sidewall 32 is approximately ⅝ in. (about 1.5 cm). In the depicted embodiment, the thickness 34 of the bracket 18 is about 1/16 in. (about 1.5 mm) and the width 36 of the slot 24 is about ⅛ in. (about 3 mm). Variations on the standard and bracket dimensions can be used as well, as will be apparent to those skilled in the art.

The standards and brackets can be made from a number of materials. Preferably, steel is used, although it is also possible to use other metals, composites, resins, plastics, fiberglass and the like provided the necessary resiliency and clamping force is achieved. In the embodiment depicted in FIG. 24, the standard 12' has front walls 22*a*, 22*b* which are noncoplanar. In the embodiment depicted in FIG. 24, each of the front walls 22*a*, 22*b* is deflected inwardly to define angles 37*a*, 37*b* which are less than 90° e.g., about 88°. Providing this configuration assists in economic production of a standard 12'. Although the rear wall 20 is flat, in one embodiment, in another embodiment, the rear wall 20' is curved inward, as shown in phantom in FIG. 24, when the standard is in a relaxed condition to provide an amount of spring-action to the rear wall. Preferably, the curved rear wall will be locally pushed back toward a flat configuration 20 by the action of locking a bracket (as described below) in a recoverable fashion so that, upon release of a bracket, the rear wall will move back to the curved configuration 20' substantially without deformation or gouging of the rear wall. In one embodiment, the standard is formed from cold rolled 16 gauge steel. In the embodiment depicted in FIG. 2, the bracket 16 is a substantially planar member having an arm region 44 and a heel region 40 terminating in a heel bottom 42. If desired, the arm region 44 can include a lip 46 for engaging with an edge or slot in a shelf.

Figure 8:
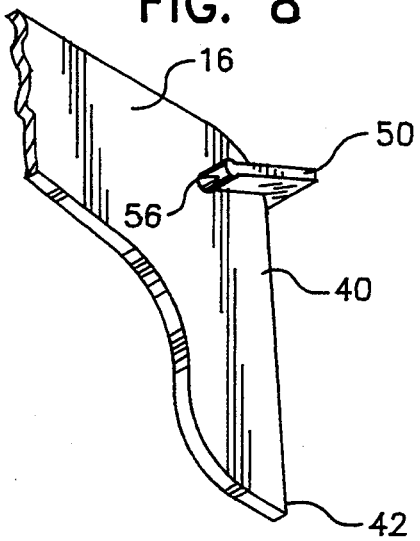
FIG. 8 is a perspective, partially exploded view showing a self engagement member and a portion of a notched bracket according to an embodiment of the present invention.

As depicted in FIG. 8, the heel region 40 of the bracket 16 is coupled to a plate 50. In the depicted embodiment, the plate 50 is positioned transversely to the planar bracket 16 and preferably in a plane approximately orthogonal to the plane of the bracket 16. The transverse plate 50 is preferably attached in a predetermined angular relationship to the bracket 16. As best seen in FIG. 2C, the angular relationship is such that when the bracket 16 is in the locked position (described below) the angle of the plate can be defined by an imaginary plane passing through the line of contact 47 between the plate 50 and the rear wall 20 and the line of contact 49 between the plate 50 and the front wall 52. According to an embodiment of the invention, an imaginary plane 52, which substantially passes through these two lines of contact is disposed at an angle 56 with respect to the longitudinal axis 54 of the standard 12 less than 90°, such as between about 75° and 85°, preferably between about 80° and 85°, and most preferably about 83°.

Figure 9:
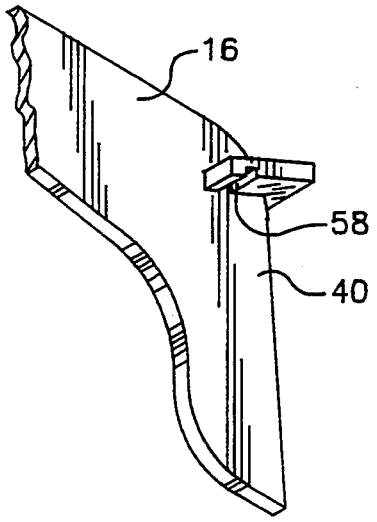
FIG. 9 are perspective views showing alternative configurations of the transverse plate connected to the heel region of a bracket.

In one embodiment, the transverse plate 50 is formed separately from the body of the bracket 16, such as by stamping, and is connected thereto e.g., by press fitting into a slot formed in the heel region 40 of the bracket 16. If desired, the plate 50 can be provided with a configuration for engaging with the correspondingly-shaped heel slot such as a terminal bulb portion 56 or a lateral slot 58, as depicted in FIG. 9.

Preferably, the heel plate is configured so that it will not become separated from the bracket extension when the bracket assembly is in place in its fully cammed and locked position. The heel slot of FIG. 9 and terminal bulb portion 56 of FIG. 8 can be used for this purpose and can be provided by a stamping procedure such as coining, in addition to such procedures as extrusion (although coining is less expensive and less prone to "warping"). There are many possible configurations of coined heel plate surfaces and corresponding bracket extension cutouts in addition to those depicted, including configurations with more or fewer coined areas, different shapes of coin areas and the like.

Figure 25:
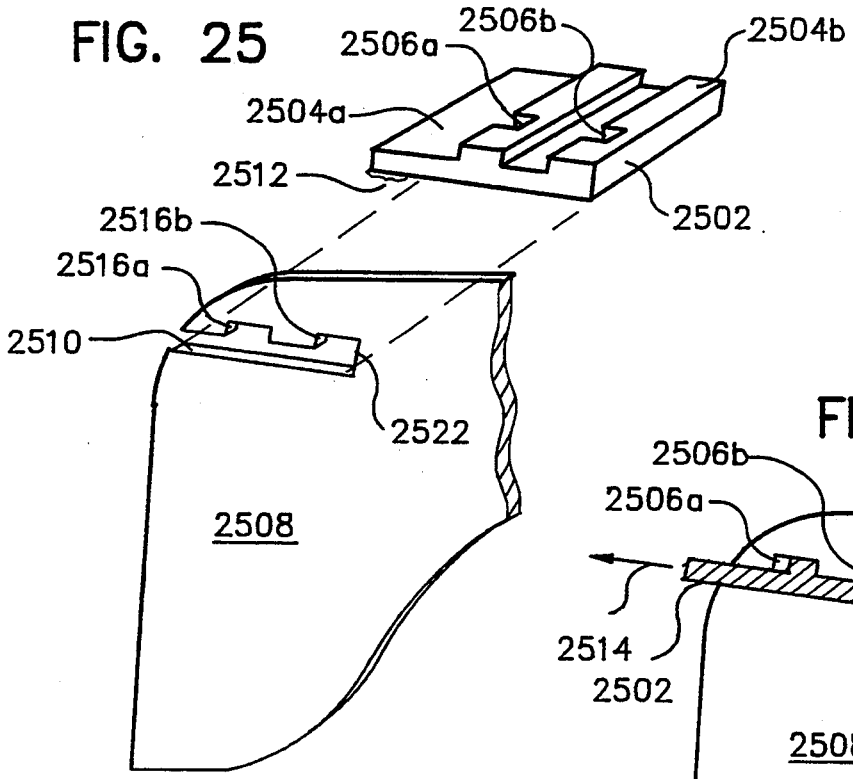
FIG. 25 is a partial, exploded perspective view of a bracket and plate, according to an embodiment of the present invention.
Figure 26A:
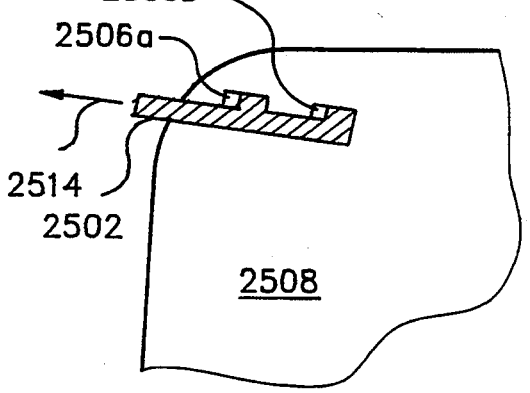
FIGS. 26A and 26B are cross-sectional views of a plate in a bracket cut-out according to an embodiment of the present invention.
Figure 26B:
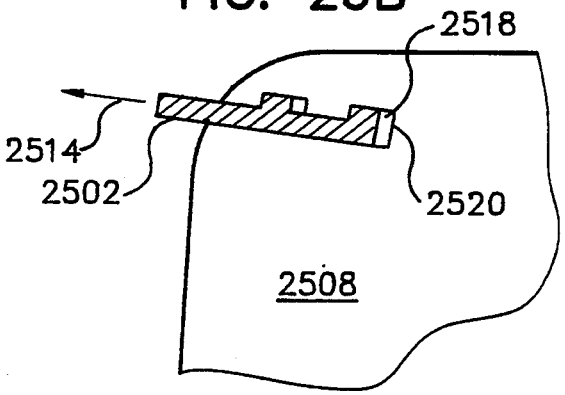
Figure 27:
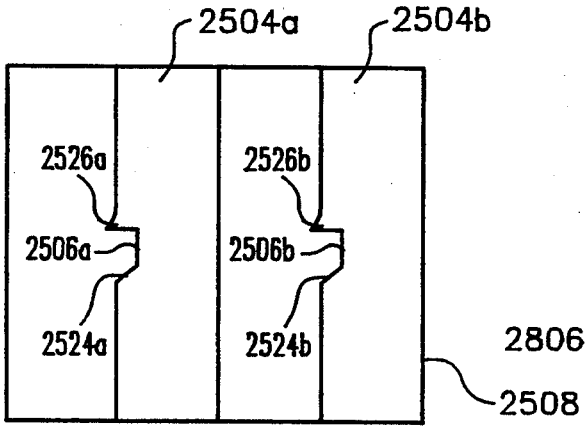
FIG. 27 is a top plan view of a heel plate according to an embodiment of the present invention.

In one embodiment, the heel plate is coupled to the bracket prior to shipment to the retailer and/or customer. However, this embodiment provides a lateral profile of the cojoined parts that is nearly 10 times the thickness of the bracket extension alone. This makes it more difficult and costly to pack, store, ship and/or display the product. Accordingly, another embodiment includes providing a heel plate and bracket which can be shipped separately and fitted-together by the customer and/or retailer. A number of configurations can be used for this purpose. As depicted in FIG. 25, a heel plate 2502 is provided with first and second ridges 2504*a*, 2504*b*. Recesses 2506*a*, 2506*b* are formed in the rear edges of the ridges 2504*a*, 2504*b*. The bracket 2508 includes a cutout region 2510 having a shape corresponding to the profile of the heel plate 2502. The heel plate 2502 has a greater width than the cutout so that a portion 2512 of the heel plate will extend outward from the bracket 2508 when the heel plate 2502 is inserted into the cutout 2510. The heel plate 2502 is inserted into the cutout 2510 and moved therethrough until the bracket 2508 is aligned with the recesses 2506*a*, 2506*b*. The plate 2502 is then moved in a rearward direction 2514 to position the forward edges of the downwardly extending portions or teeth of the cutout 2516*a*, 2516*b* in the recesses 2506*a*, 2506*b* as shown in FIG. 26*b*. This results in a space 2518 between the plate 2502 and the forward edge 2520 of the cutout 2510. This will not interfere with the function of the bracket since, once the bracket is placed in the locked position in the standard and is in a weight-bearing mode, the force on the plate 2502 with respect to the bracket 2508 will tend to be in the rearward direction 2514.

In one embodiment, the plate 2508 can be configured to assist in proper positioning such as by providing the slots 2506*a*, 2506*b* with a sloped or ramped edge 2524*a*, 2524*b* and/or a stop extension 2526*a*, 2526*b*.

Figure 28:
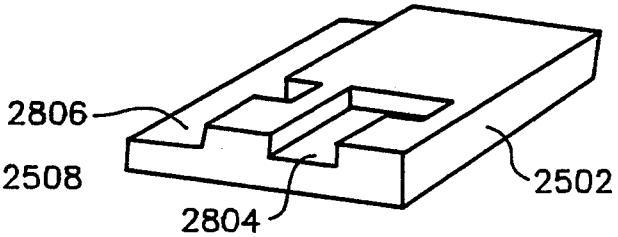
FIG. 28 is a perspective view of a heel plate, according to an embodiment of the invention.

According to another embodiment, as depicted in FIG. 28, a plate 2802 can be configured with one or both slots 2804, 2806 extending only halfway across the width of the plate 2802 so that when the plate is inserted in a correspondingly-shaped cutout in the bracket as far as it will go, it will be positioned in a centered location.

Preferably, the plate 2508, ridges 2504 and/or recesses 2506 are tapered or wedge-shaped so that when the plate is positioned in its final location, as described above, there will be a tight fit between the parts and enough compression at corresponding surfaces to hold the pieces in place with respect to one another. Since, as noted above, the locked and weight- bearing bracket assembly typically causes a rearward force 2514 on the plate, some or all of the rearward movement of the plate which engages the edges 2516 with the recesses 2506 can be achieved as a result of locking the bracket assembly into position. Other shapes for engagement between the plate 50 and the bracket body 16 will be apparent to those skilled in the art. The plate 50 is preferably formed of the same material, as the bracket 16, e.g., steel, but can also be formed of other materials having the necessary strength, as will be apparent to those skilled in the art. The plate 50 can be coupled to the bracket 16 by means other than a press fit, such as by welding, brazing, pinning, key and slot arrangements, latching, crimping, bolting, screwing, and integral formation and/or bending although it is believed, that, in general, such alternative attachments are not as economic as a press fit.

Figure 6:
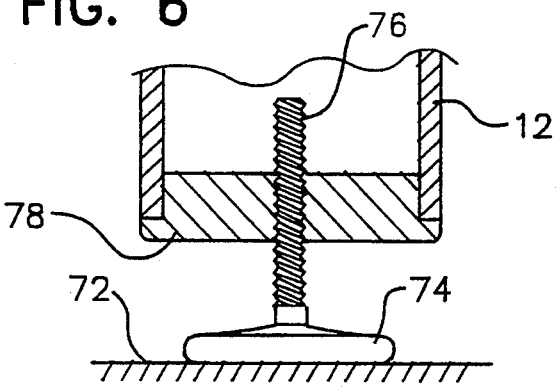
FIG. 6 depicts a foot arrangement for a standard.
Figure 7:
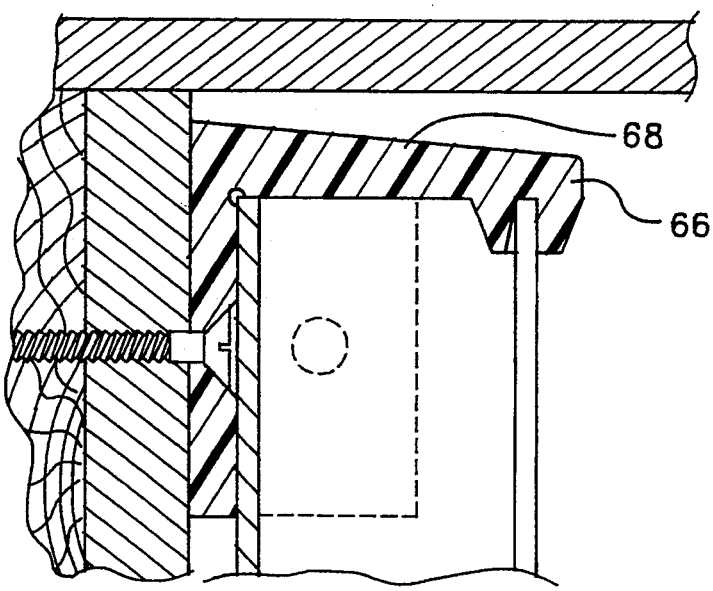
FIG. 7 is a vertical cross-section of a standard, showing a attachment and cap device.

The standard 12 can be attached to the wall 14 by a number of devices and methods. As depicted in FIG. 4, a U-shaped holding apparatus 60 can be screwed or bolted to the wall 14 and the standard 12 can be accommodated in the opening of the attachment device 60 and coupled thereto e.g., by set screws 62*a*, 62*b*. This type of arrangement provides the advantage that the standard 12 can be produced as a fungible slotted steel tube without the need for modifying to accommodate attachment devices, (such as by providing screw holes and the like). Furthermore, the attachment devices 60 can be easily provided with decorative and aesthetically pleasing exterior surfaces. Additionally, by using attachment devices 60, the interior surfaces of the standard 12 are maintained smooth and even for accommodating the plate 50 at any desired height, as described more fully below. The upper end 64 of the standard 12 can be held by a cup-shaped attachment device 66, as depicted in FIG. 7 which also provides a cap 68 for the standard 12. Alternatively, a separate cap 70 (FIG. 2) can be provided which fits as a plug in the upper end of the standard 12. As depicted in FIG. 1, the attachment devices 60 can be positioned at each end of a standard. Alternatively, the lower end of one or more standards 12 can be supported on a surface 72 (FIG. 6) by a foot 74, preferably with a screw height adjustment 76 passing through a bottom plate 78.

Figure 29A:
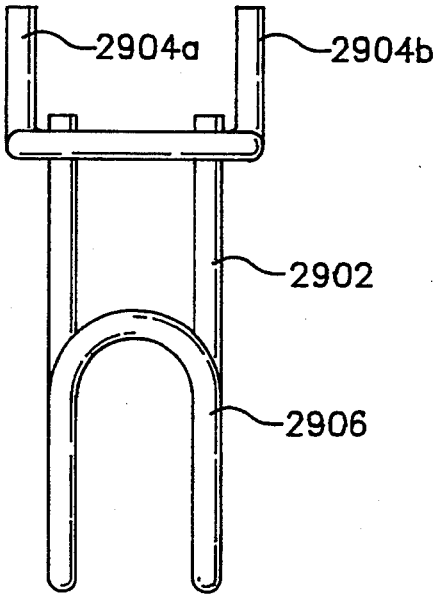
FIG. 29A and 29B are, respectively, front and side elevational views of a hanger for a standard attachment device according to an embodiment of the present invention.
Figure 29B:
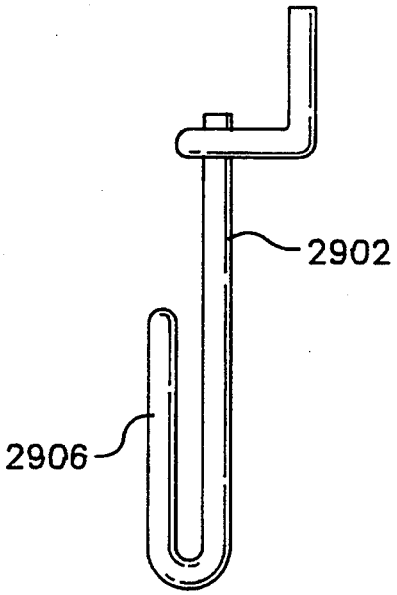

In another embodiment, the attachment device 60 can be attached to a wall or other surface by a hook mechanism such as the hanger 2902, depicted in FIGS. 29A and 29B. In the depicted embodiment, the hanger 2902 is configured to engage with a peg board or slot wall, such as by providing first and second prongs 2904*a*, 2904*b* configured and spaced (e.g., at a spacing of about $\frac{7}{8}$") to engage with a peg board or slot wall. The lower portion of the hanger 2902 terminates in a hook 2906. The hook 2906 can be used to support a holding apparatus 60 so that it will be unnecessary to screw the holding apparatus 60 into a wall. Preferably, the holding apparatus 60 will be provided with a recess, slot or pocket to accomodate the hook 2906. Preferably, the recess slot or pocket is shaped so that the holding apparatus 60 will be snugly and securely positioned adjacent the peg board or slot wall when fully engaged with the hanger 2906.

Figure 5:
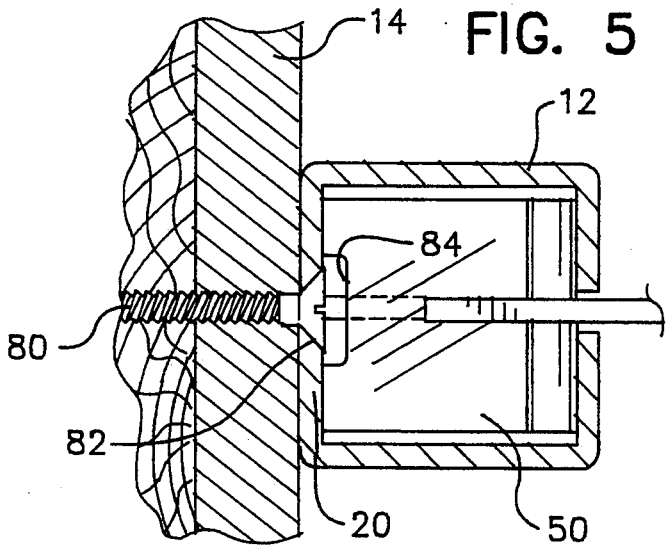
FIG. 5 is a cross-sectional view generally corresponding to the view of FIG. 4, but showing an alternative attachment configuration.

In yet another configuration, As depicted in FIG. 5, the standard 12 can be directly attached to a wall 14 by a known attachment device such as a screw 80, accommodated in a screw hole 82 formed in the back of the wall 20 of the standard 12. Preferably, the screw 80 is countersunk in a beveled screw hole so as not to interfere with positioning of the plate 50. Alternatively, the plate 50 may be provided with a cutout region 84 to permit passage over or around a screw head.

Figure 2B:
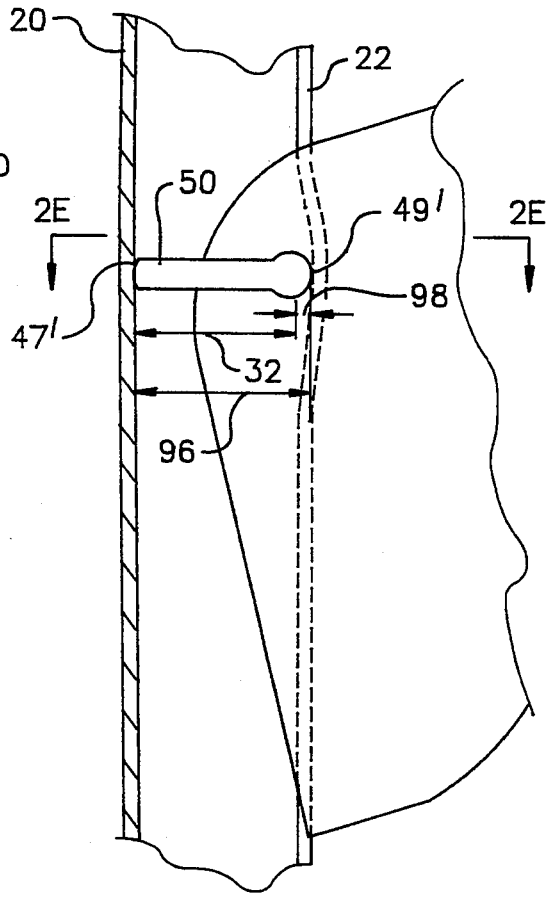
Figure 2D:
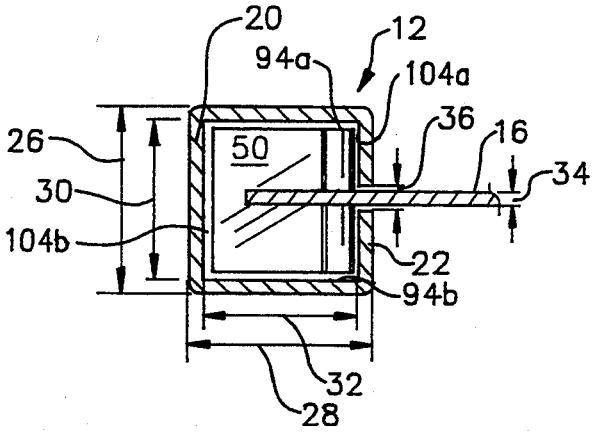
FIG. 2D, 2E and 2F are cross-sectional view taken along lines 2D—2D, 2E—2E, 2F—2F, of FIGS. 2A, 2B and 2C, respectively.
Figure 2E:
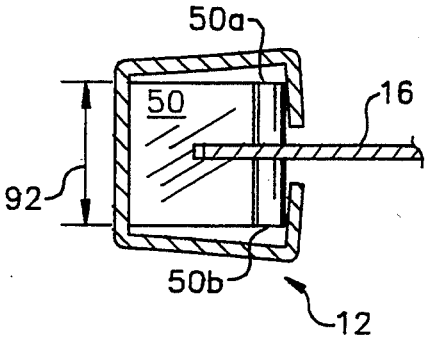
Figure 2C:
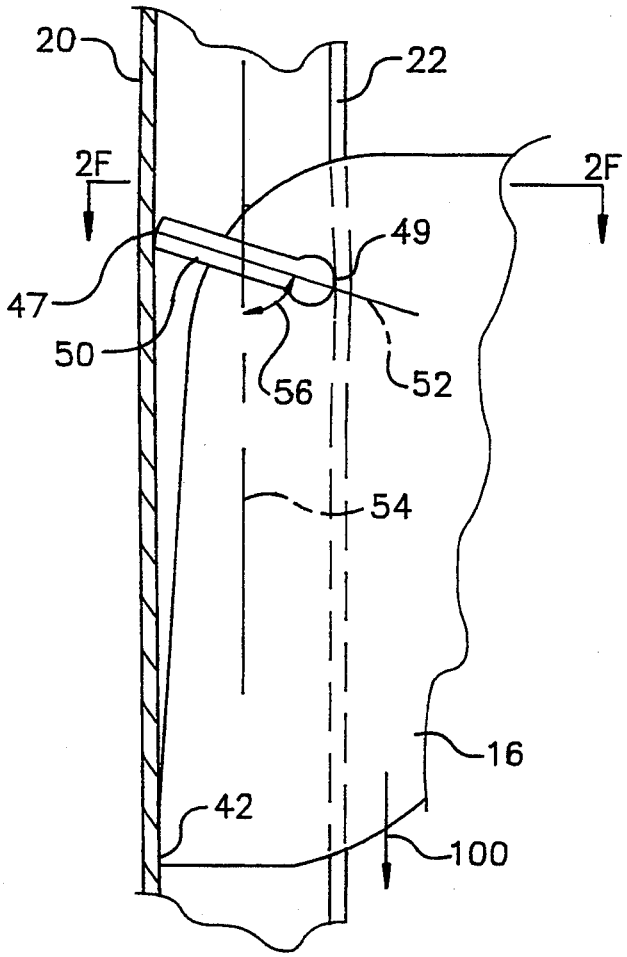

In the embodiment depicted in FIGS. 2E and 2B, the plate 50 has a cross-sectional shape such that the side edges 50*a*, 50*b* of the plate 50 can be positioned substantially adjacent and parallel to, although preferably slightly spaced from, the interior surfaces of the standard 12. In the embodiment depicted in FIGS. 2A–2F, the cross-sectional interior area of the standard 12 is substantially square or rectangular and the cross-sectional shape of the plate 50 is similar, i.e., also substantially square or rectangular. Other shapes can also be used. In one embodiment, the effective width 92 (FIG. 2E) of the rear edge of the plate 50 (i.e., the width between the most widely spaced points of the plate 50 which contact the rear wall 20 of the standard 12) is approximately 9/16 in. (about 15 mm), thus leaving a slight lateral space 94*a*, 94*b* (FIG. 2D) between the side edges 50*a*, 50*b* of the plate 50 and the adjacent walls of the standard 12.

The plate 50 also has a length 96. The length 96 can be defined with respect to the walls of the standard 12 when the plate 50 has placed the walls in the maximum stressed condition depicted in FIG. 2B. The plate length 96 is the distance along an imaginary plane orthogonal to the longitudinal axis 54 of the standard 12 between a line which is the projection on said imaginary plane of the line of contact 47' between the plate 50 and the rear wall 20 of the standard and the projection of the line of contact 49' between the plate 50 and the front wall 22. In rough terms, when the plate 50 is a substantially planar element, the length 96 is roughly equal to the dimension of the plate 50 measured along the plane of the planar plate in a direction parallel to the plane of the bracket 16. The length 96 of the plate 50 is a predetermined amount 98 greater than the interior depth 32 of the unstressed standard. In other words, the length 96 of the plate 50 exceeds the depth 32 of the unstressed standard by an amount 98. The plate is long enough to provide the desired support substantially from friction between the plate and the standard wall. Specifically, the difference in length 98 is large enough that when the bracket is configured in the locked position (FIG. 2C) the force from the elastically deformed standard 22 which compresses the plate between the front wall 22 and the rear wall 20 creates sufficient friction between the plate 50 and the front and rear walls 20, 22, combined with the friction of the heel bottom 42 on the rear wall 20 that the bracket 16 can support a desired amount of downward force 100 (such as from mass loading on the bracket 16) to maintain the bracket 16 in its position with respect to the standard 12 substantially solely in response to friction forces. The difference in length 98 is sufficiently small that the compressive force of the standard 12 on the plate 50 is not high enough to cause substantial plastic deformation of the standard walls 20, 22 or plate 50 or to cause punch-through or rupture of the standard wall, for the strength and hardness of the materials of which the standard 12 and plate 50 are made. In one embodiment, the distance 98 is greater than about 0.006 inches (about 0.15 mm), preferably between about 0.008 and about 0.012 inches (between about 0.2 mm and about 0.3 mm), most preferably about 0.01 inches (about 0.25 mm).

In use, a procedure for coupling a bracket 16 to the standard 12 at its desired height begins with inserting the plate 50 and a part of the heel portion through the upper opening 102 of a standard. Because the length of the plate 50 exceeds the depth of the standard 12, the plate 50 (and attached bracket 16) must be tilted 16' as shown by the phantom lines in FIG. 2. The bracket in this configuration is then moved to the desired height. In this configuration, as depicted in FIG. 2A, the plate 50 can be spaced 104*a*, 104*b* from the front and rear surfaces 22, 20 of the standard 12 with the arm 44 of the bracket extending through the slot 24 and outward from the standard 12. When the bracket 16 has been placed at the desired position at the standard 12, the bracket is pivoted from the angled configuration 16' to a locked configuration 16 (FIG. 2). This may be done by a user grasping the arm portion of the bracket 16 and pulling the bracket towards the desired configuration. Alternatively, a tool may be used for grasping and/or moving the bracket. The locking procedure is depicted in greater detail in FIGS. 2A–2F. As noted previously, the procedure begins with the plate 50 spaced 104*a*, 104*b* from the front and rear walls 22, 20 of the standard 12.

Figure 24:
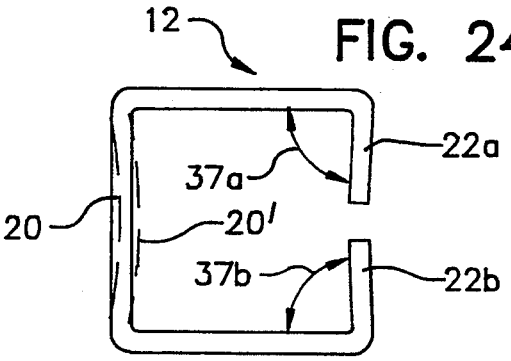
FIG. 24 is an top plan view of a standard according to an embodiment of the present invention.

As the bracket 16 is moved toward the locked configuration, the front edge of the plate 50 will contact the interior surface of the front wall 22 of the standard and the rear edge of the plate 50 will contact the interior surface of the rear wall of the standard 12. At this point, no further movement of the bracket 16 towards the final configuration is possible without deformation. Although some minor deformation of the plate 50 may be experienced, the major deformation is deformation of a portion of the walls of the standard 12 as best seen in FIGS. 2B and 2E. The deformation depicted in FIGS. 2B and 2E is exaggerated for clarity. When the unstressed front walls are angled inwardly, as depicted in FIG. 24, the amount of outward deflection of the front walls (if any) will be smaller than if there was no unstressed inward angle. The deformation of the walls of the standard 12 is an elastic deformation. Plastic deformation, such as would be involved with gouging the interior surface of the walls is substantially avoided. Although there may be minor plastic deformation, such deformation, if it exists, is insubstantial, i.e., is sufficiently slight that it does not noticeably detract from the appearance or continuous adjustability of the device.

Rotation of the plate 50 and bracket 16 continues to the point of maximum deformation in which the full length 96 of the plate 50 is accommodated by a deformation equal to the difference in distance 98 between the plate length 96 and the undeformed standard interior depth 32. In the case of a substantially planar plate, this point occurs approximately when the plane of the planar plate 50 is substantially orthogonal to the longitudinal axis 54 of the standard 12.

Figure 2F:
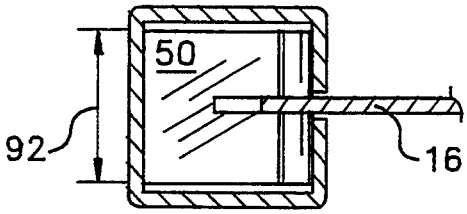
Figure 3:
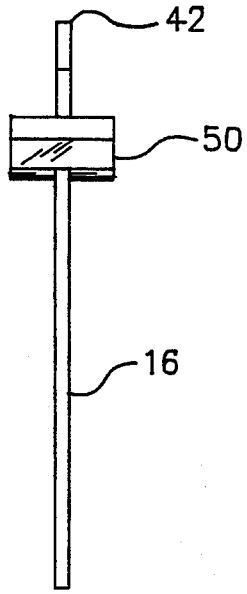
FIG. 3 is a top plan view of a bracket.

Further movement of the bracket 16 brings the plate 50 towards an angled configuration 56, permitting some (but preferably not total) relaxation of the elastically deformed standard 12. Rotation continues until a rotation stop engages. In the depicted embodiment, the rotation stop is formed by the bottom region of the heel 42 which contacts the rear wall 20 of the standard 12. Because the greatest force on the plate occurs at the maximum deformation configuration (FIG. 2B), the system tends to resist any movement toward this configuration and urge movement away from this configuration so that positioning to the configuration depicted in FIG. 2C involves an over-center scheme. In practice, as the user moves the bracket through the maximum deformation configuration (FIG. 2B) and into the locked configuration (FIG. 2C) the user feels a "snap" type tactile feedback. This provides a number of advantages. It assures the user that the bracket has been properly locked into position. It also assures that the amount of compression, and thus, the degree of friction which is provided, is a predetermined and reproducible amount. The reproducible amount is achieved because the stop action of the heel bottom 42 places the plate 50 in a predetermined angular configuration and thus provides a predetermined amount of elastic deformation of the standard, in turn providing a predetermined amount of compression on the plate. At this point, there will be some small elastic deformation of the standard 12 although it will be less than the maximum deformation 98, depicted in FIG. 2B. In the configuration depicted in FIG. 2C, the plate 50 contacts and is compressed between the front wall 22 and rear wall 20 of the standard 12. There is a minor amount of force of the heel bottom 42 on the rear wall 20. However, substantially all of the compressive force of the walls 22, 20 of the standard is borne by the plate 50 and there is substantially no compression of a portion of the bracket 16 between the walls 22, 20 of the standard 12. As depicted in FIG. 2F, when the bracket 16 is in the locked position, the effective width 92 of the rear edge of the plate 50 is greater than the thickness 34 of the bracket 16.

Figure 10:
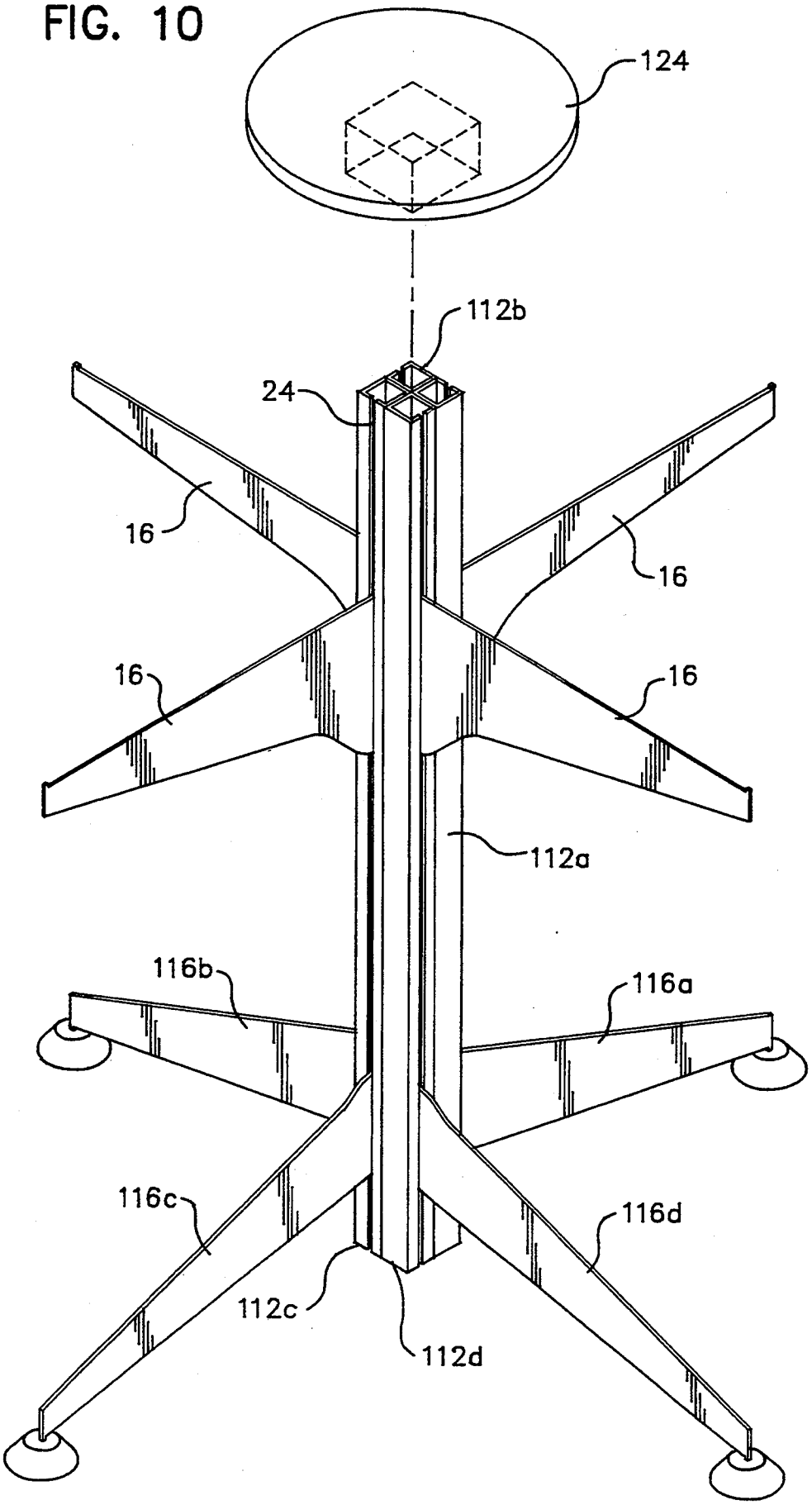
FIG. 10 is a perspective view, partially-exploded, of a free-standing standard and bracket system.
Figure 11:
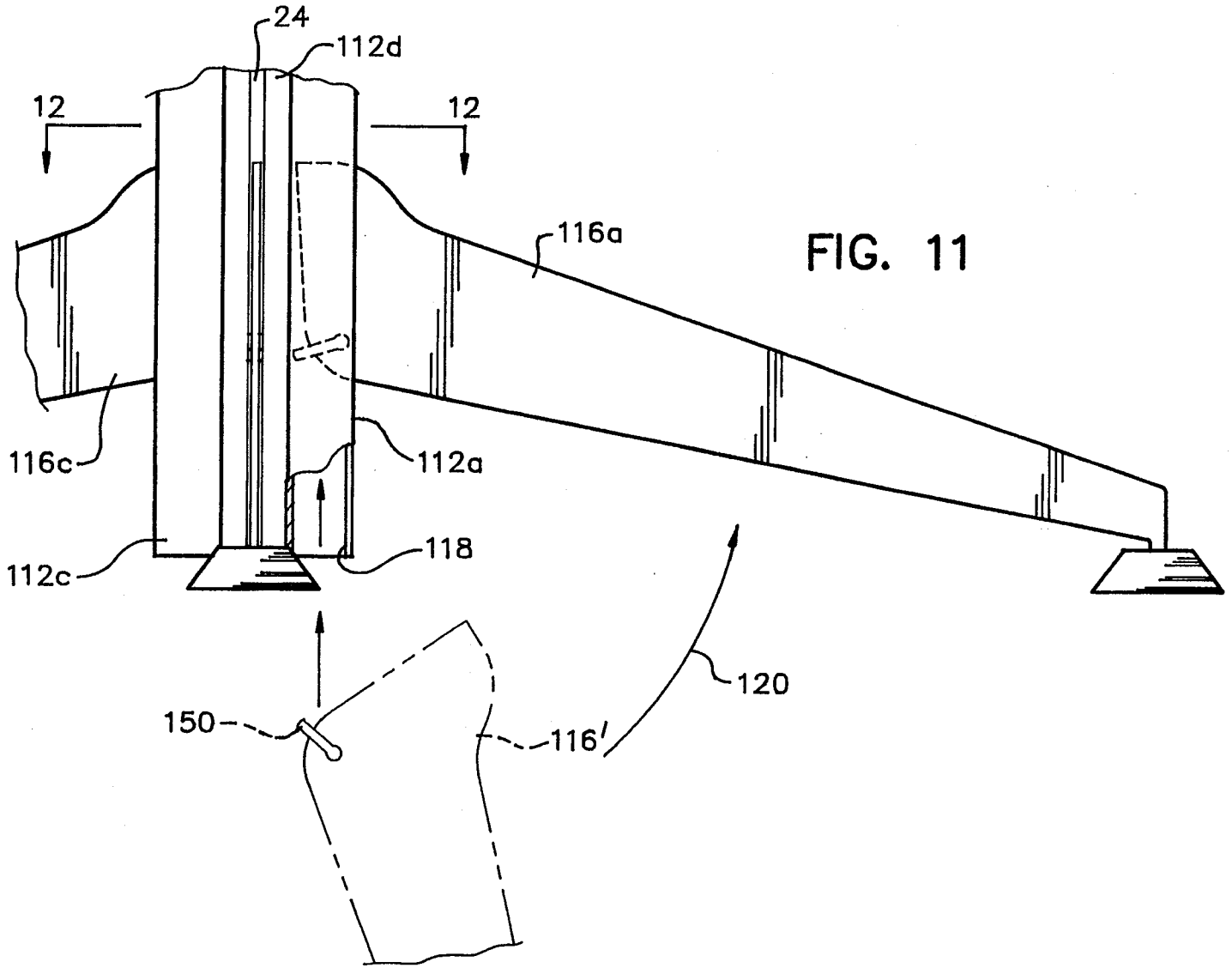
FIG. 11 is a plan view of a portion of the free-standing standard and bracket system, showing a foot bracket prior to insertion, in phantom.
Figure 14:
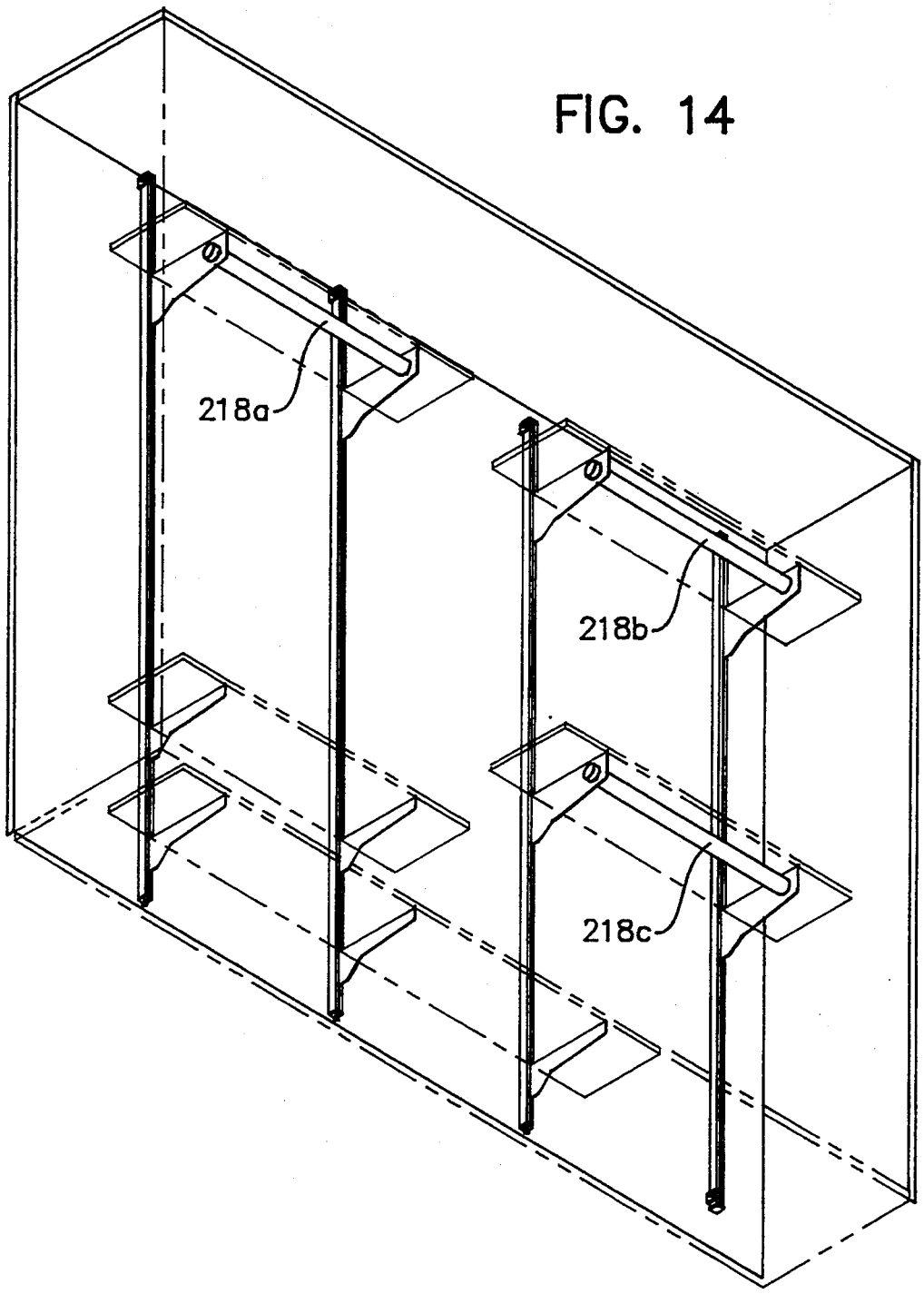
FIG. 14 is a perspective view showing a bracket and standard system for supporting shelving and clothes hanging bars in a closet.

FIG. 10 depicts another embodiment of the present invention. According to FIG. 10, one or more standards are positioned in a free-standing configuration, i.e., without direct attachment to a wall. The free-standing configuration can be used to support items other than the brackets 16, such as a table top 124. The standards 112*a*, 112*b*, 112*c*, 112*d* are maintained in the desired free-standing position, preferably by one or more legs 116*a*, 116*b*, 116*c*, 116*d*. As depicted in FIG. 11, the legs 116*a*, 116*b*, 116*c*, 116*d* can be coupled to the standards 112*a*, 112*b*, 112*c*, 112*d* in a manner substantially similar to the coupling of the brackets 16 to the standards 112*a*, 112*b*, 112*c*, 112*d*. In particular, the legs 116*a*, 116*c* can be provided with a heel region having a transverse plate 150 that inserted through a bottom opening 118 of one of the standards 112*a* and pivoted 120 to a locked position 116*a*. The apparatus of FIG. 10 can be "knocked-down", by removing the legs 116 and arms 16 to provide a compact package of components, e.g., for shipping. In this way, a compact shipping package for a support/display system can be provided which is smaller than the "footprint" of the assembled device.

Figure 12:
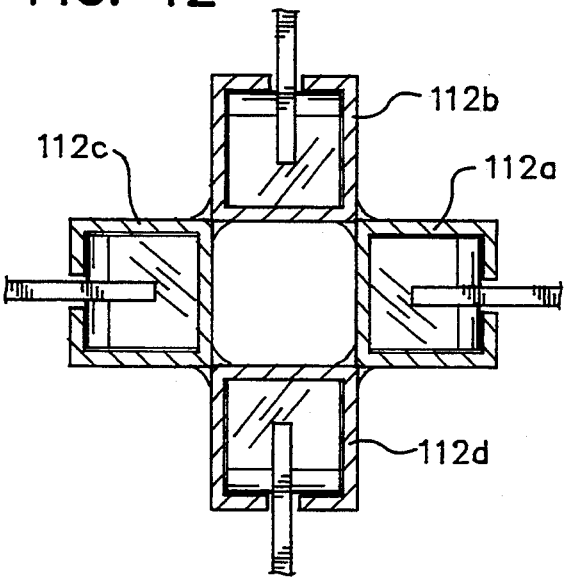
FIG. 12 is a cross-sectional view taken through line 12—12 of FIG. 11.
Figure 13:
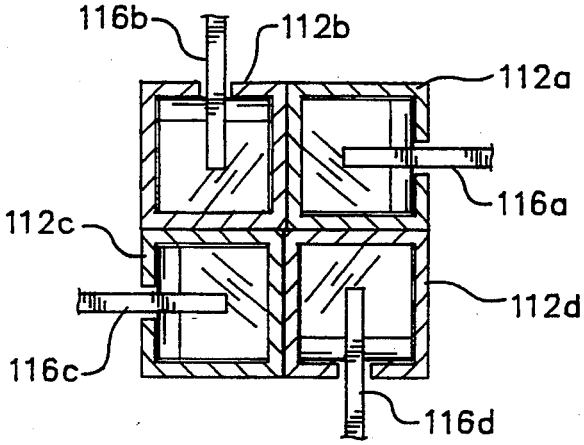
FIG. 13 is a cross-sectional view similar to the view of FIG. 12 but showing an alternative embodiment.

As depicted in FIG. 12, a plurality of standards 112*a*–112*d* can be connected to each other such as by welding, brazing, bolting, clamping, adhesives or the like. A number of configurations of the plurality of standards is possible, including the square pinwheel configuration depicted in FIG. 13 or a cruciform configuration depicted in FIG. 12.

In addition to the shelf support system depicted in FIG. 1, the present invention has a number of other uses, including supporting bars such as clothes hanging bars 218*a*, 218*b*, 218*c*.

Figure 15:
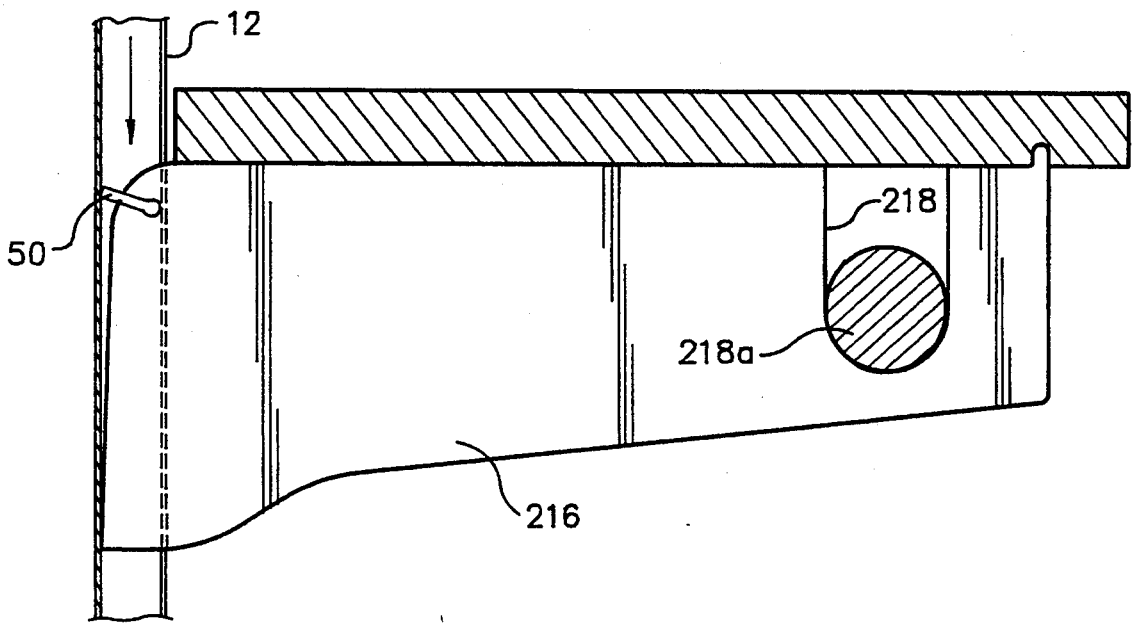
FIG. 15 is a partial cross-sectional view of a standard and bracket system for supporting a clothes hanging and shelf device.

As depicted in FIG. 15, a bracket 216 can be provided with a recess 218 for accommodating a bar 218*a* such as a clothes hanging bar. Such a bracket can be configured to engage with a standard 12 in a manner similar to that described above.

Figure 16:
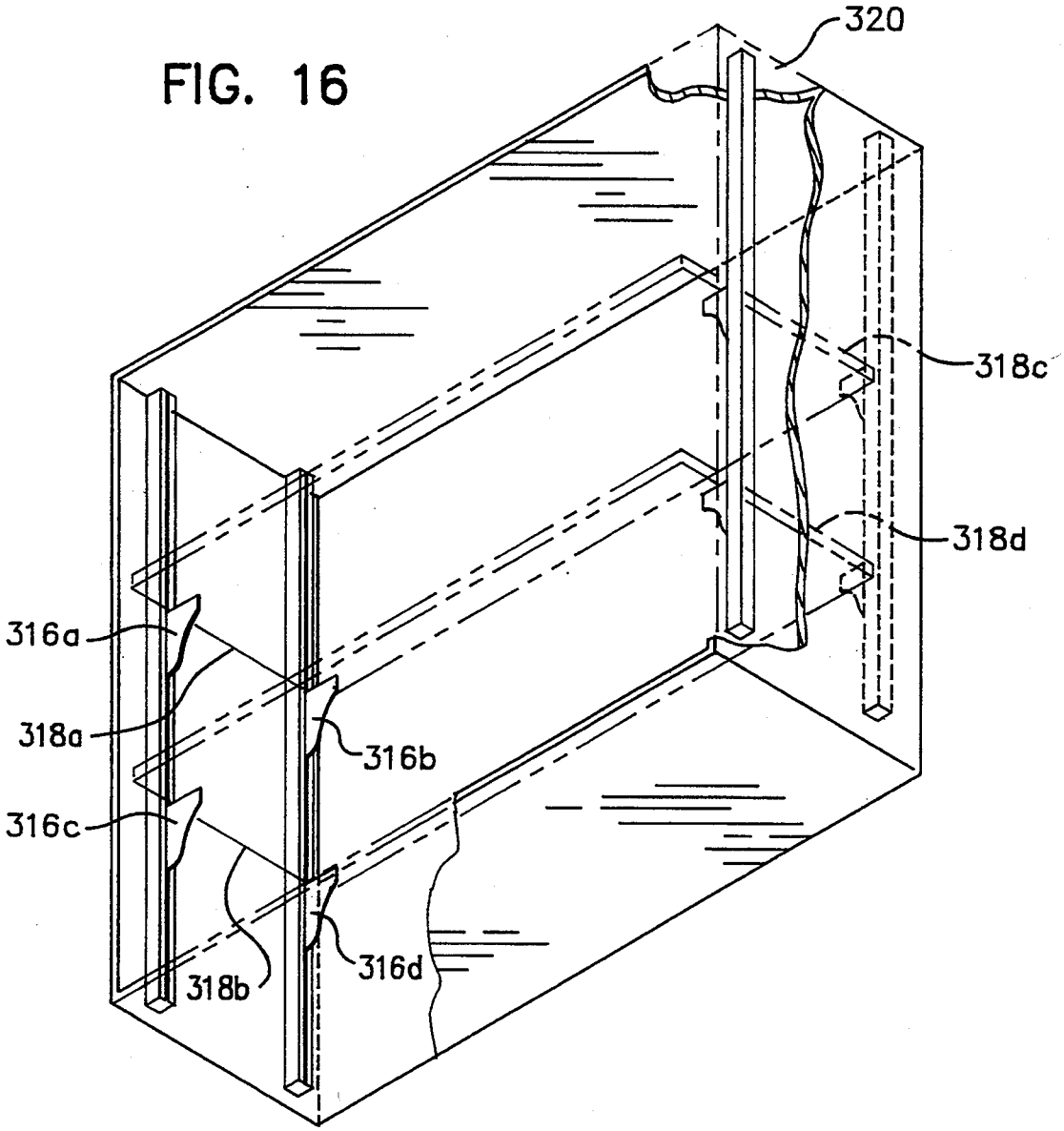
FIG. 16 is a perspective view depicting a standard and bracket system for end support of shelving in a cabinet.
Figure 17B:
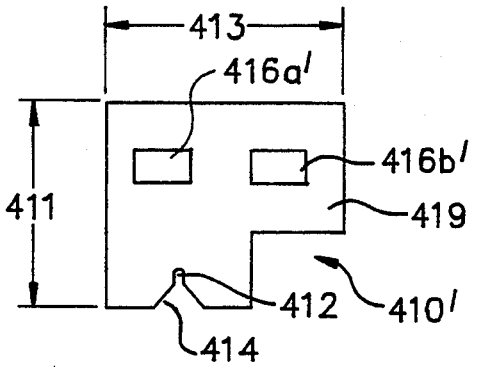
FIG. 17B is an elevational view of a planar shelf-engagement member according to an embodiment of the present invention.
Figure 17A:
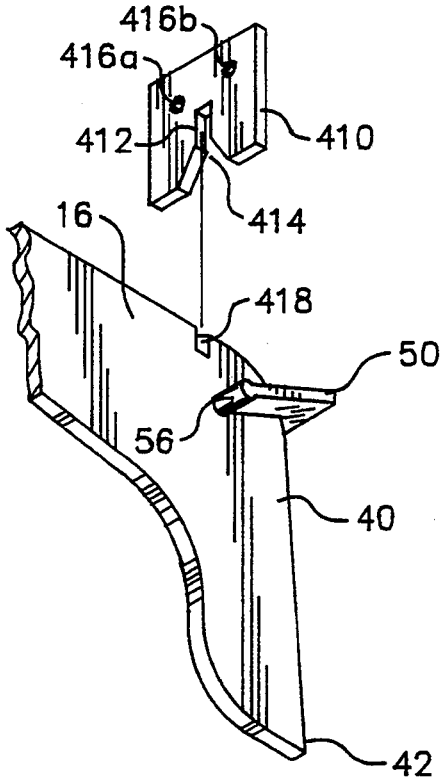
FIG. 17A is a perspective, partially exploded view showing a bracket and a planar shelf-engagement member according an embodiment of the present invention.

As depicted in FIG. 16, the standard and bracket system of the present invention can be used for supporting shelves at their ends 318*a*, 318*b*, 318*c*, 318*d*, such as in the interior of a cabinet 320. As seen in FIG. 16, the support brackets 316*a*, 316*b*, 316*c*, 315*d* can be provided with relatively short arms. In this configuration, it may be necessary to use an extension tool, fitting over the bracket arm, in order to achieve sufficient torque to pivot the shortened brackets 13*a*–13*d* into the locked configuration.

As depicted in FIG. 17, when it is desired to permit screw attachment of a bracket to a shelf, the tip 410 of the bracket body 416 can be twisted 90° to provide a screw hole 418 which would have an axis orthogonal to the plane of the shelf supported by the bracket 416.

In light of the above description, a number of advantages of the present invention can be seen. A support system can be provided in which shelves or other items to be supported are coupled to brackets in a secure, economical and attractive manner. A support system can include brackets which can be locked in continuously-selectable (rather than discrete) locations along the length of the standard to provide for infinite adjustability, i.e., adjustment to an infinite number of positions, in a fashion that is economically feasible. Among the items contributing to economic feasibility are the ability to use a thin bracket which can be produced by a stamping process, the ability to attach a transverse plate by a press fit method, and the ability to use commonly available slotted steel tubes for the standard portions. The present invention provides for an attractive and long-lived apparatus. A standard bracket system can avoid gouging or plastic deformation of components, and/or punch-through or other externally visible deformation of the standards. A standard and bracket system can provide for positive locking with a tactile feedback. A standard and bracket system can provide a desired load-bearing ability arising substantially solely from the frictional forces and without substantial plastic deformation of the apparatus.

A number of variations and modifications invention can also be used. The support system can also be used for supporting items other than shelving, rods and the like, including supporting items for display, supporting signs or pictures, supporting lighting fixtures, and the like. Supporting items other than shelving may be accommodated by modification of the shape of the shelf-engaging members, such as a tab which is other than planar or L-shaped or which is angled at an angle other than 90°, or an elongated shelf-engaging member with a channel shaped other than C-shaped or having a channel plane which is not at 90° to the slot plane and/or is not parallel to the longitudinal axis of the shelf-engaging member or of the bracket. The ridge and groove configuration, when used, can have other shapes, such as other cross-sectional shapes like a "T" shape, a "L" shape and the like, can be on other surfaces of the channel, can be an intermittent ridge/groove rather than a longitudinally continuous ridge/groove. Devices other than a ridge/groove or a channel can be used for engaging with a shelf or other supported item such as nails, screws, bolts, latches, pins, rivets, adhering, welding, brazing, soldering or the like. Some aspects of the present invention can be used without using other aspects. For example, it would be possible to provide a shelf-engaging member without providing a bracket having a transverse plate. The bracket in the locked position may provide an arm which is other than horizontal such as being angled upwardly or downwardly. The present invention can be used in connection with standards which have shapes other than a square or rectangular shape such as those having a triangular or circular cross-section (with corresponding modifications of the plate shape). The present invention can provide standards in which the slot is not straight, for example in which the slot is inclined or spiral-shaped. The present invention can provide the standard in two or more pieces which can be connected together. The present invention can provide for standards with two or more slots. The standards can have a non-straight longitudinal axis such as being curved. The present invention can include openings to permit insertion of the plate into the standard at points other than the top or bottom of the standard. The present invention can provide for transverse structures attached to the bracket other than planar-shaped plates, including square or triangular cross-section bars large enough to contact both of two opposed surfaces. The plate can be non-symmetrical with respect to the bracket plane. The bracket can be provided with additional modifications for accommodating attachment to other devices such as holes, dimples, threaded holes, hooks, buckles and the like. The bracket can be provided with one or more hinged sections so that portions of the bracket can be swung away if desired. The standard can be positioned in a configuration other than vertical such as angled or horizontal. Rather than providing separate standard attachment devices 60 and hangers 2902, it is possible to provide a unitary piece which is a standard attachment device that includes peg board or slot wall coupling apparatus. Alternatively, it would be possible to provide slots or recesses in the rear wall of a standard so that the standard could be directly supported by a hanger.

Although the present invention has been described by way of a preferred embodiment and certain variations and modifications, other variations and modifications can also be used, the invention being defined by the following claims.

What is claimed is:

1. A method for supporting a shelf in a desired location comprising:

positioning an elongated standard with a hollow interior region in a desired location, said standard having a front wall portion with at least a first slot and a backwall portion;

providing a bracket having an arm portion and a heel portion, said heel portion having a cutout region;

providing a locking device with a first region having a cross-sectional shape configured to fit within said cutout of said bracket;

inserting said portion of said locking device into said cutout to couple said locking device to said bracket wherein a portion of said locking device extends rearwardly to said standard from said heel of said bracket; and positioning said bracket and said coupled locking device in a fixed position partially within said standard, with at least a part of said arm portion extending outward from said standard to maintain said bracket at a fixed position with respect to said standard, wherein said fixed position can be any of an infinite number of positions along at least a portion of said standard, and wherein, in said fixed position, said locking device contacts said backwall and said front wall portions of said standard.

2. The method of claim 1 wherein when said bracket is at said fixed position there is substantially no plastic deformation of said standard.

3. Support apparatus usable for supporting shelving comprising:

an elongated standard with a hollow interior region, said standard having a front wall portion and at least a first slot and a backwall portion;

a bracket having an arm portion and a heel portion positionable partly within said standard with at least a part of said arm portion extending outward from said standard, said bracket having a cutout formed in said heel portion with at least a first tooth extending into said cutout portion; and a plate having a cross-sectional shape configured to fit within said cutout of said bracket and having a recess formed therein, said plate being at least partially positioned within said cutout with said tooth located at least within said recess to couple said plate to said heel portion of said bracket forming a bracket assembly at least partially positionable at a fixed position within said standard to maintain said bracket at a fixed location with respect to said standard;

wherein, in said fixed position, said locking device contacts said backwall and said front wall portions of said standard.

4. The support apparatus of claim 3 wherein in said fixed position there is substantially no plastic deformation of said standard.

* * * * *